United States Patent [19]

Sauerteig et al.

[11] Patent Number: 4,788,133

[45] Date of Patent: Nov. 29, 1988

[54] COLOR PHOTOGRAPHIC RECORDING MATERIAL

[75] Inventors: Wolfgang Sauerteig, Leverkusen; Günter Renner, Bergisch Gladbach; Sieghart Klötzer, Cologne; Jens-Peter Grimm, Leverkusen, all of Fed. Rep. of Germany

[73] Assignee: Agfa-Gevaert Aktiengesellschaft, Leverkusen, Fed. Rep. of Germany

[21] Appl. No.: 15,738

[22] Filed: Feb. 17, 1987

[30] Foreign Application Priority Data

Feb. 26, 1986 [DE] Fed. Rep. of Germany ..... 3606086

[51] Int. Cl.[4] ..... G03C 1/46; G03C 1/02; G03C 7/32

[52] U.S. Cl. ..... 430/505; 430/506; 430/558; 430/567

[58] Field of Search ..... 430/505, 506, 567, 558

[56] References Cited

U.S. PATENT DOCUMENTS 4,590,155 5/1986 Klotzer ..... 430/567

FOREIGN PATENT DOCUMENTS 0090479 10/1983 European Pat. Off. ..... 430/505
1128291 4/1962 Fed. Rep. of Germany .

*Primary Examiner*—Paul R. Michl
*Assistant Examiner*—Lee C. Wright
*Attorney, Agent, or Firm*—Connolly and Hutz

[57] ABSTRACT

A recording material having improved sharpness and color reproduction contains as uppermost layer a green-sensitive silver chloride emulsion having a layered grain structure, the ratio of diameter to thickness of the silver halide grains being at most 5.

5 Claims, No Drawings

COLOR PHOTOGRAPHIC RECORDING MATERIAL

This invention relates to a highly sensitive color photographic recording material comprising several silver halide emulsion layers having improved sharpness.

It is known that colored photographic images may be produced using recording materials which comprise on a layer support red-sensitive, green-sensitive and blue-sensitive silver halide emulsion layers and non diffusing color couplers for producing the cyan, magenta and yellow partial color image, the color of the partial color image produced being complementary to the spectral sensitivity of the silver halide emulsion layer. Conventional color photographic materials also contain other layers, such as in particular a yellow filter layer between the blue-sensitive silver halide emulsion layers situated on top and the underlying green- and red-sensitive silver halide emulsion layers. Color photographic recording materials comprising double and triple layers for the various spectral regions are known from GB-PS No. 818 687, from DE-PS No. 1 121 470 and from U.S. Pat. Nos. 3,663,228 and 3,849,138. In this case, too, the upper of the two partial layers sensitive to light of the same spectral region has the higher sensitivity.

A similar structure is known from U.S. Defensive Publication No. T 860 004.

According to DE-OS No. 2 018 341 and U.S. Pat. No. 3,843,369, the graininess of a partial color image is said to be improved by using three silver halide emulsion partial layers having the same spectral sensitivity, but different general sensitivity, each more sensitive partial layer being arranged further away from the layer support than each less sensitive partial layer. In addition, a maximum color density of at most 0.6 and, together, of at most 1.0 of obtained in the middle and in the upper partial layer, which may be achieved by reducing the coupler content, i.e. by increasing the ratio of silver halide to coupler.

In general, color photographic materials, particularly color negative materials, have a structure in which at least one red-sensitive layer, one green-sensitive layer, one yellow filter layer and one blue-sensitive layer are applied in this order to a support. Since the human eye is most sensitive in the green spectral region, the image produced in the green-sensitive layer has the greatest influence on the subjectively perceived sharpness. In the conventional structure described above, however, the sharpness of the image produced in the green-sensitive layer suffers from the scattering of light in the blue-sensitive layers situated above the green-sensitive layer. In order to improve sharpness, therefore, it has already been proposed to arrange the green-sensitive layer above the blue-sensitive layers. Compositions such as these are described, for example, in DE-OS No. 2 427 491, in DE-AS No. 1 128 291 and in U.S. Pat. No. 2,344,084. In the example of DE-AS No. 1 128 291, a blue-sensitive layer (B) is surmounted on a support (T) by a red-sensitive layer (R), a green-sensitive layer (G) and, as the uppermost layer, a yellow filter layer (F). In a composition such as this, a very large proportion of the blue light does not reach the blue-sensitive layer because it is absorbed in the overlying yellow filter layer. In addition, recording materials comprising a green-sensitive layer as the uppermost layer are known from DE-OS No. 2 453 654 and EP-OS No. 90 479. In the normal use of silver bromide iodide emulsions in a green-sensitive layer as the uppermost layer without an overlying filter layer absorbing blue light, the blue/-green color separation deteriorates considerably on account of the natural sensitivity of the basically green-sensitized silver bromide iodide emulsion in the blue spectral region. The color reproduction of recording materials such as these is thus seriously impaired. If a filter layer absorbing blue light is arranged above the green-sensitive layer in a recording material of this type, the poor color separation is certainly improved, but at the expense of blue sensitivity which is reduced, depending on the filter density.

Photographic recording materials comprising a greensensitive silver halide emulsion rich in silver chloride as the uppermost layer are already known from DE-OS No. 3 241 638 and from DE-OS No. 3 241 645. However, the emulsion grains for the most part have a high aspect ratio and, as a result of their large surface, also lead to a correspondingly coarse color graininess.

The object of the present invention is to provide photograhic recording materials having improved sharpness and improved color reproduction.

A color photographic recording material comprising at least one green-sensitive, at least one blue-sensitive and at least one red-sensitive silver halide emulsion layer and color couplers associated therewith has now been found, in which a green-sensitive silver halide emulsion layer is arranged in such a way that, on exposure, it is closest of all the photosensitive silver halide emulsion layers to the subject to be photographed and contains at least 50% and preferably at least 90% silver halide grains of which at least 50 mole % and preferably at least 80 mole % consist of silver chloride, have a layered grain structure and show a crystal form in which the ratio of diameter to thickness is at most 5. In one particularly preferred embodiment, the recording material contains at least two blue-sensitive, two green-sensitive and two red-sensitive silver halide emulsion layers and no blue light absorbing filter-layer.

In particularly preferred embodiments, the following layers are applied to a layer support (compositions 1 to 7). Further layers, particularly auxiliary layers, such as antihalo layers, hardening layers and filter layers, may be arranged between, above and below the individual layers:

Layer structure

| Compositions | | | | | | |
|---|---|---|---|---|---|---|
| 1 | 2 | 3 | 4 | 5 | 6 | 7 |
| G | G | GG | G | g | g | GG |
| R | g | G | g | G | G | BB |
| B | R | g | B | GG | BB | RR |
| S | r | RR | b | r | GG | G |
| | B | R | R | R | RR | g |
| | b | r | r | RR | R | B |
| | S | BB | S | BB | r | b |
| | | B | | B | B | R |
| | | b | | b | b | r |
| | | S | | S | S | S |

In this Table:

r = red-sensitive partial layer, low sensitivity
R = red-sensitive partial layer, medium sensitivity
RR = red-sensitive partial layer, maximal sensitivity
g = green-sensitive partial layer, low sensitivity
G = green-sensitive partial layer, medium sensitivity
GG = green-sensitive partial layer, maximal sensitivity b=blue-sensitive partial layer, low sensitivity
B=blue-sensitive partial layer, medium sensitivity
BB=blue-sensitive partial layer, maximal sensitivity
S=support, e.g. of a Cellulosetriacetat.

The silver halide emulsions rich in silver chloride which are used in accordance with the invention are known per se.

Grains of the type in question have a core and at least one layer surrounding the core which is different in its properties from the core (core/shell emulsions). Thus, it is known from DE-AS No. 1 169 290 and from GB-PS No. 1 027 146 that a silver chloride shell can be precipitated onto a silver bromide core. DE-OS No. 2 308 239 and U.S. Pat. No. 3,935,014 relate to emulsions for the production of direct-positive images which comprise silver halide grains having a locally confined phase of high silver chloride content.

EP-OS No. 80 905 describes silver halide emulsions comprising grains rich in silver chloride which have a surface layer consisting essentially of silver bromide.

Preferred silver chloride emulsions for the green-sensitive layer correspond to the following embodiments:

Embodiment I

The silver halide emulsion essentially contains chloride as the halide, the grains comprising at least one zone $Z_{Br}$ of high bromide content. The grains are characterized in that 1. at least 60 mole % of the halide is chloride, 2. the bromide content in the zone $Z_{Br}$ is at least 50 mole % and 3. there is no bromide-rich zone $Z_{Br}$ at the surface of the silver halide grains.

The zone $Z_{Br}$ rich in silver bromide may be present as core or as a layer within the silver halide grain. 20% by volume of the silver halide of the core are preferably situated further from the crystal center than the zone $Z_{Br}$ rich in silver bromide.

Basically, the silver halide grains in the bromide-rich zone $Z_{Br}$ and in the other regions may contain chloride, bromide, iodide or mixtures thereof as the halide. The transition from the bromide-rich zone $Z_{Br}$ to an adjacent zone of different composition may be either sudden or continuous.

In one preferred embodiment, the proportion of chloride in the total halide content is at least 85 mole % and, more especially, at least 90 mol %. In another preferred embodiment, the zone $Z_{Br}$ rich in silver bromide consist essentially, for example to a level of at least 90%, or exclusively of silver bromide.

Embodiment II

In another preferred embodiment, the silver halide emulsion of the green-sensitive layer consists of grains which essentially contain chloride as the halide and of which the grains have a layered grain structure of at least two regions differing in their halide composition, for example a core and at least one shell. The silver halide grains are characterized in that 1. at least 60 mole % of the halide is chloride and 2. at least one region B contains at least 10 mole % silver bromide and preferably at least 25 mole % silver bromide, but less than 50 mole % silver bromide.

The region B may be present both as core and as a shell surrounding a core. The grains preferably contain a core surrounded by at least one region B. In this case, the region B may be present as a shell within the silver halide grain or on the surface of the crystal.

In one special embodiment, the crystal core is successively provided with two shells containing silver bromide, the two shells differing distinctly from one another in their bromide content.

A bromide-containing shell having a local bromide concentration of from 30 to 45 mole % is preferably situated on the crystal surface of the chloride-rich silver halide crystal.

In another embodiment, the bromide concentration, based on total halide, is from 3 to 8 mole %.

Irrespective of the particular embodiment, the silver halide grains in the green-sensitive layer may contain chloride, bromide, iodide or mixtures thereof as the halide both in the core and in the other regions. The transision from one region to an adjacent region of different composition may be sudden or continuous.

In one preferred embodiment, the proportion of chloride in the total halide content is at least 85 mole % and more especially at least 90 mole %.

The silver halide emulsions to be used in accordance with the invention for the green-sensitive layer may be prepared by standard methods (for example single inflow, dual inflow, with constant or accelerated material feed). The emulsions are preferably prepared by the dual inflow method with control of the pAg-value. In this connection, reference is made to Research Disclosure No. 17643 of December 1978, Sections I and II, published by Industrial Opportunities Ltd., Homewell Havant, Hampshire, PO 9 1 EF, Great Britain.

The silver halide emulsions may be precipitated in the presence of doping agents, such as cadmium, lead, copper or zinc, as described for example in EP-OS No. 17 148.

Other substances normally used as ripening agents may also be present during precipitation, including for example compounds of sulfur, selenium, tellurium, iridium, gold, palladium, platinum, thiourea derivatives, formamidine sulfonic acid, tin(II) chloride.

In another embodiment, the silver halide may be precipitated in the presence of divalent and/or polyvalent cations, such as $La^{3+}$, $Tl^{3+}$, $Co^{2+}$, $Rh^{3+}$.

The silver halide grains may be in the form of, for example, cubes, octahedrons or tetrahedrons. Their grain size is preferably from 0.1 to 2.5 μm and more especially from 0.2 to 1.0 μm. In one embodiment of the invention, the emulsion has a narrow grain size distribution in which at least 95% by weight of the grains have a diameter which differs by no more than 40% from the mean grain diameter. However, the emulsions may also have a broad particle size distribution in which at least 10% and preferably 20% of the silver halide grains have a diameter which differs by at least 40% from the average grain diameter.

The silver halide emulsion to be used in accordance with the invention in the green-sensitive layer essentially contains silver halides rich in silver chloride which have an aspect ratio of at most 5. The silver halides are in the form of predominantly compact crystals which are, for example, cubic or octahedral or have transitional forms. They may be characterized in that they essentially have a thickness of more than 0.2 μm and a diameter of at most 2.5 μm.

Basically the same silver halide emulsions as in the green-sensitive layer may be used in the other photosensitive silver halide emulsion layers, although other photosensitive silver halide emulsions containing chloride, bromide and iodide or mixtures thereof may also be used.

All the emulsions are preferably chemically sensitized to high surface sensitivity at the surface of the grains. They may be chemically sensitized by known methods, for example with active gelatin or with compounds of sulfur, selenium, telleurium, gold, palladium, platinum, irridium, the pAg-values varying from 4 to 10, the pH values from 3.5 to 9 and the temperatures from 30° to 90° C. Chemical sensitization may be carried out in the presence of heterocyclic nitrogen compounds, such as imidazoles, azaidenes, azapyridazines and azapyrimidines, and thiocyanate derivatives, thioethers and other silver halide solvents. Instead or in addition, the emulsions according to the invention may be subjected to reduction sensitization, for example by hydrogen, by a low pAg (for example below 5) and/or a high pH (for example above 8), by reducing agents, such as tin(II) chloride, thioureadioxide and aminoboranes.

The surface rpie nuclei may also be present as troglodyte nuclei (sub-surface nuclei) in accordance with DE-OS No. 23 06 447 and U.S. Pat. No. 3,966,476. Other methods are described in the above-mentioned Research Disclosure No. 17643, Section III.

The emulsions may contain antifogging agents and stabilizers. Particularly suitable auxiliaries of this type are azaindenes, preferably tetra- or pentaazaindenes, especially those substituted by hydroxyl or amino groups. Compounds such as these are described, for example, in the Article by Birr in Z. Wiss. Photo.47, (1952), pages 2–58. Other suitable stabilizers and antifogging agents are described in Research Disclosure No. 17643 of December 1978, Section VI, published by Industrial Opportunities Ltd., Homewell Havant, Hampshire, P09 1 EF, Great Britain.

The antifogging agents and stabilizers may be added to the photosensitive silver halide emulsion before chemical ripening, during chemical ripening or after chemical ripening. In one preferred embodiment, they are added to the casting solution after chemical ripening.

The emulsions may be optically sensitized in known manner, for example with the usual polymethine dyes, such as neutrocyanines, basic or acidic carbocyanines, rhodacyanines, hemicyanines, styryl dyes, oxonols and the like. Sensitizers such as these are described by F.M. Hamer in "The Cyanine Dyes and Related Compounds", (1964). Particular reference is made in this connection to Ullmanns Enzyklopadie der technischen Chemie, 4th Edition, Vol. 18, pages 431 et seq. and to the abovementioned Research Disclosure No. 17643, Section IV.

The color photographic recording materials normally contain at least one silver halide emulsion layer unit for recording light of each of the three spectral regions red, green and blue.

Each of the above-mentioned silver halide emulsion layer units may comprise a single silver halide emulsion layer or even several silver halide emulsion layers. Color photographic recording materials comprising double layers for the various spectral regions are known, for example, from U.S. Pat. Nos. 3,663,228, 3,849,138 and 4,184,876. Color photographic recording materials comprising triple layers are known from DE-OS No. 2 018 341 and from DE-OS No. 3 413 800.

In addition, formalin binding agents, for example the iminopyrazolones known from DE-OS No. 3 148 108 and from U.S. Pat. Nos. 4,414,309, may be present in any layer.

In addition to the layers already mentioned, the color photographic recording material according to the invention may contain other non-photosensitive auxiliary layers, for example adhesive layers, antihalo layers or surface layers, more especially intermediate layers between the photosensitive layers for effectively preventing developer oxidation products from diffusing from one layer into another. To this end, intermediate layers of the type in question may also contain certain compounds which are capable of reacting with developer oxidation product. Layers such as these are preferably arranged between adjacent photosensitive layers of different spectral sensitivity. A silver halide emulsion of low sensitivity may also be incorporated in intermediate layers, having an average grain diameter of around 0.8 μm or less and containing chloride, bromide and optionally iodide. A layer such as this has a particularly beneficial effect on the sensitivity of the adjoining layers. However, the silver halide emulsion of low sensitivity may also be directly introduced into the photosensitive layers. The layers may additionally contain the usual constituents, such as scavengers, DIR couplers and also DAR couplers.

Color couplers capable of reacting with color developer oxidation product to form a dye are preferably associated with the photosensitive silver halide emulsion layers. The color couplers are preferably present immediately adjacent and, in particular, in the silver halide emulsion layer.

Thus, the red-sensitive layer may contain for example a color coupler for producing the cyan partial color image, generally a coupler of the phenol or α-naphthol type. The green-sensitive layer may contain for example at least one color coupler for producing the magenta partial color image, normally a color coupler of the 5-pyrazolone type. The blue-sensitive layer may contain, for example, at least one color coupler for producing the yellow partial color image, generally a color coupler containing an open-chain ketomethylene group.

The color couplers may be, for example, 6-, 4- or 2-equivalent couplers. Suitable couplers are described, for example, by W. Pelz in an article entitled "Farbkuppler" appearing in "Mitteilungen aus den Forschumgslaboratorien der Agfa, Leverkusen/Munchen", Vol. III, page 111 (1961); by K. Venkataraman in "The Chemistry of Synthetic Dyes", Vol. 4, 341 to 387, Academic Press (1971) and by T. H. James in "The Theory of the Photographic Process", 4th Edition, pages 353–362, and are also known from Research Disclosure No. 17643 of December 1978, Section VII, published by Industrial Opportunities Ltd., Homewell Havant, Hampshire, P09 1 EF, Great Britain.

The usual masking couplers may be used for improving color reproduction. In addition, the recording material may contain DIR compounds and white couplers which do not produce a dye on reaction with color developer oxidation products. The inhibitors releasable from the DIR compounds may be released either directly or by non-inhibiting intermediate compounds.

Reference is made in this connection to GB-PS No. 953 454, U.S. Pat. Nos. 3,632,345, 4,248,962 and GB-PS No. 2 072 363 and to Research Disclosure No. 10226 of October, 1972.

Examples of particularly suitable yellow couplers are given in the following Table:

Y1
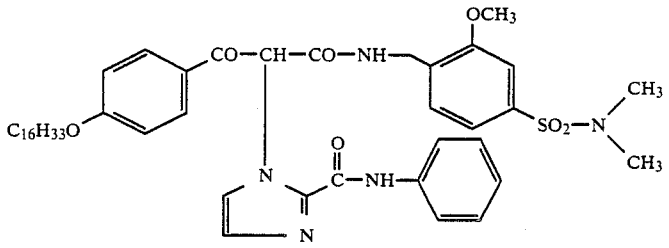
Y2
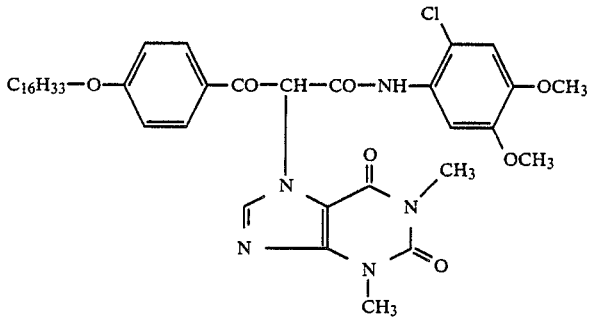
Y3
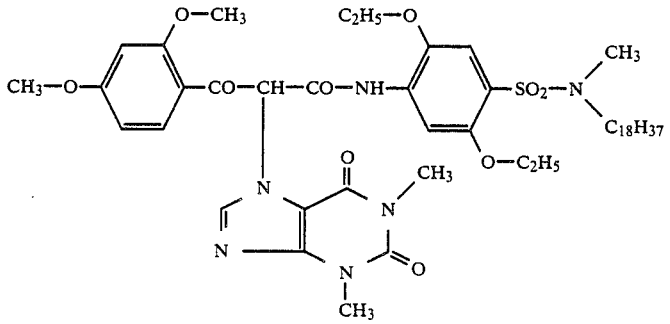
Y4
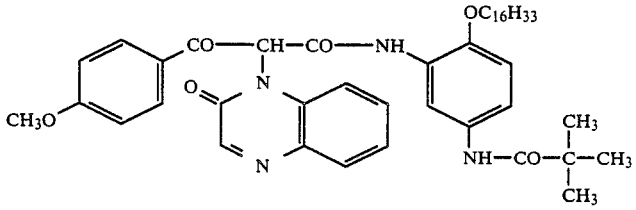
Y5
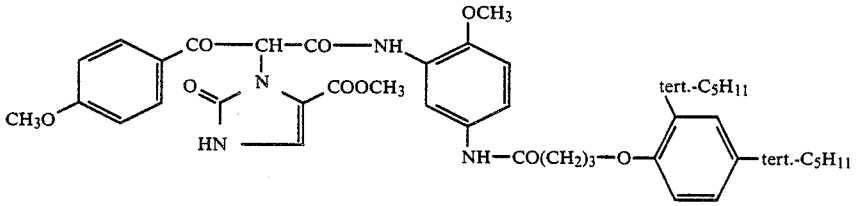
Y6
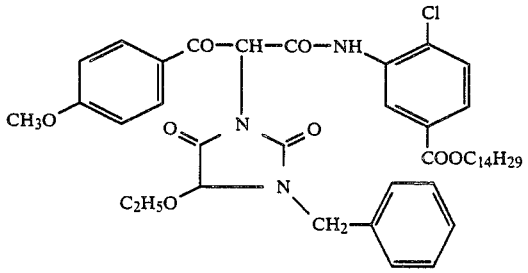

-continued
Y7
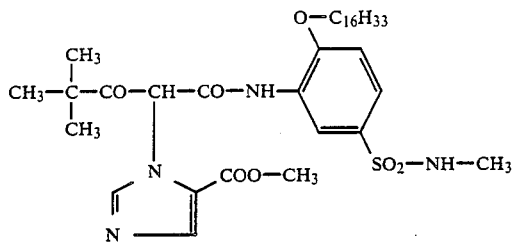
Y8
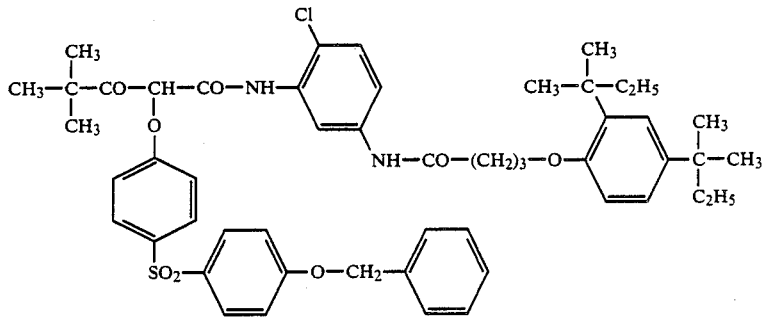
Y9
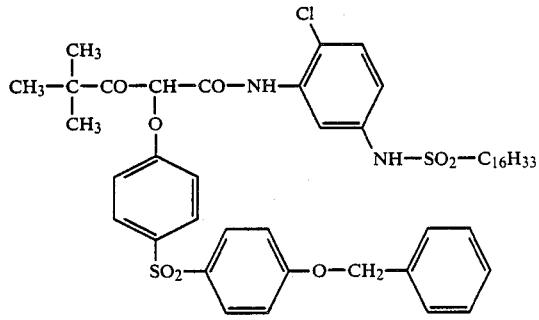
Y10
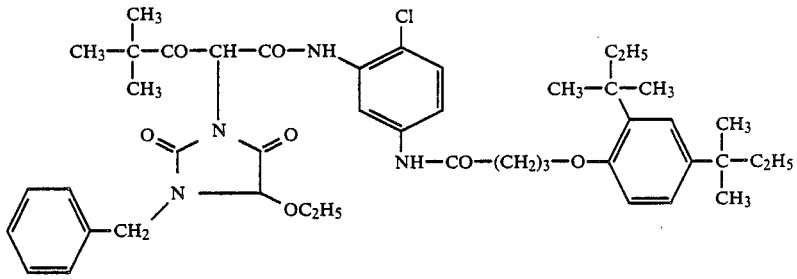
Y11
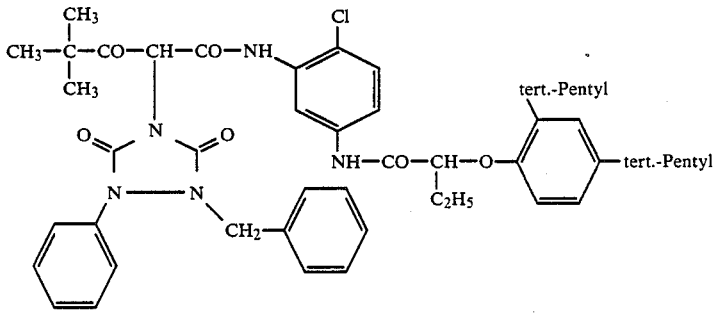

-continued
Y12
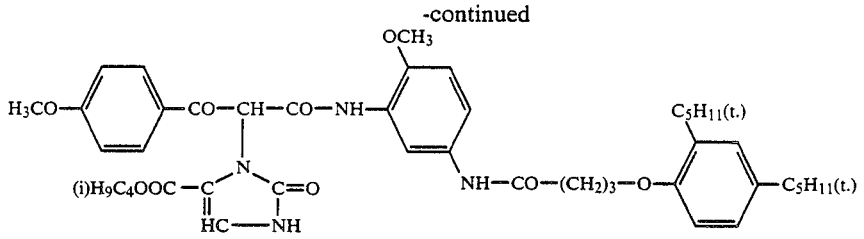
Y13
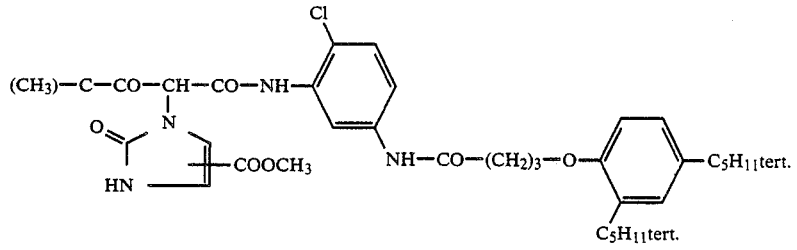
Y14
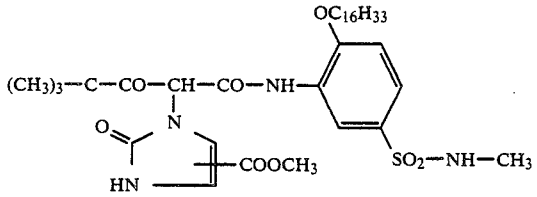
Examples of particularly suitable cyan couplers are given the following Table:
C1
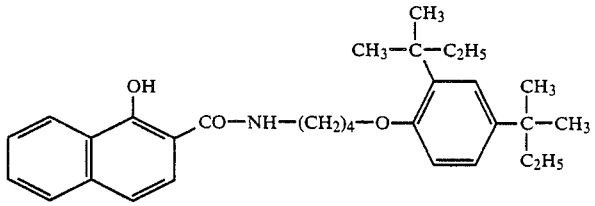
C2
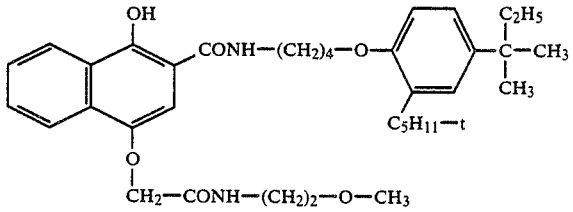
C3
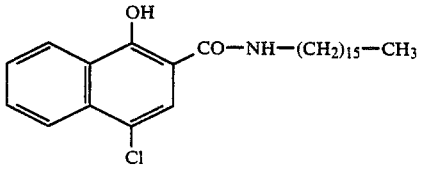
C4
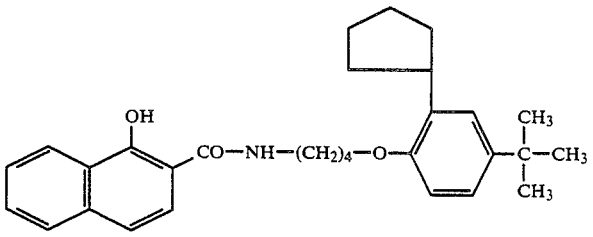

-continued
C5
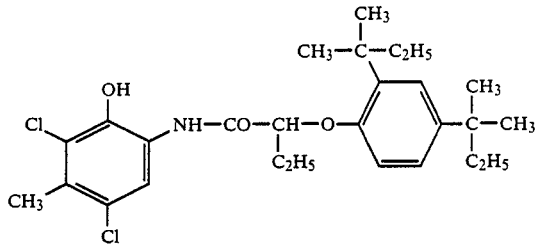
C6
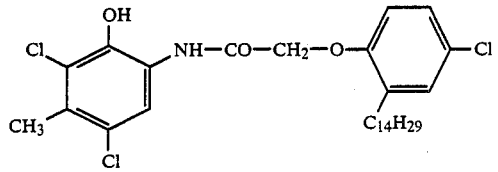
C7
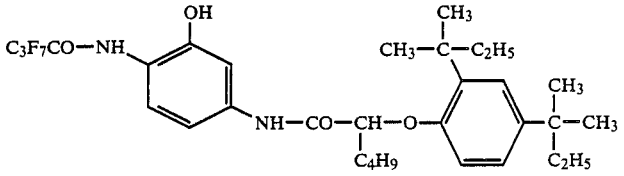
C8
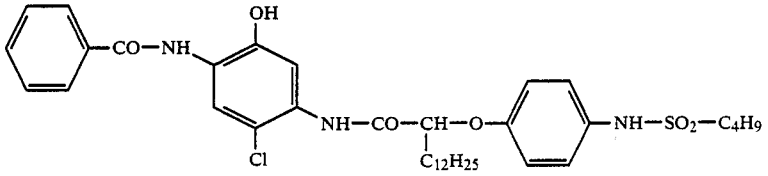
C9
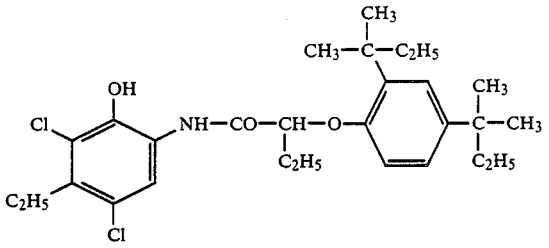
C10
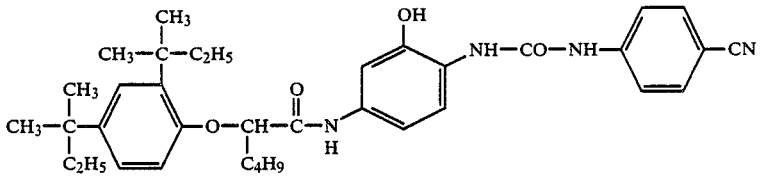
C12
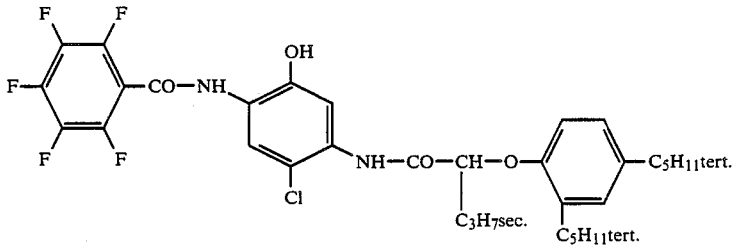
The following compounds may be used as magenta couplers:

Pp 1
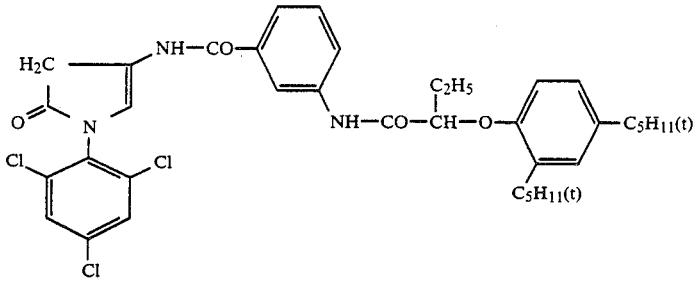
Pp 2
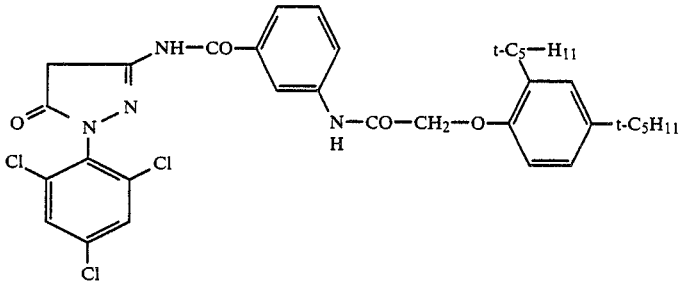
Pp 3
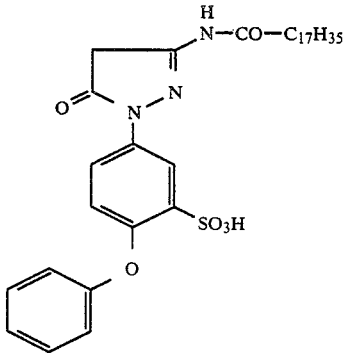
Pp 4
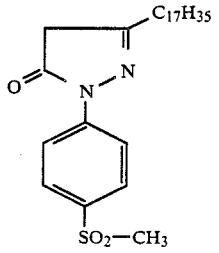
Pp 5
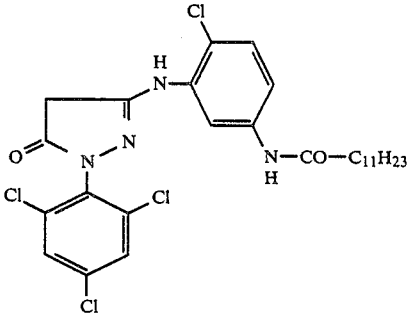
Pp 6
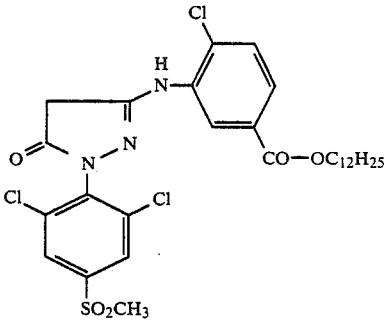
Pp 7
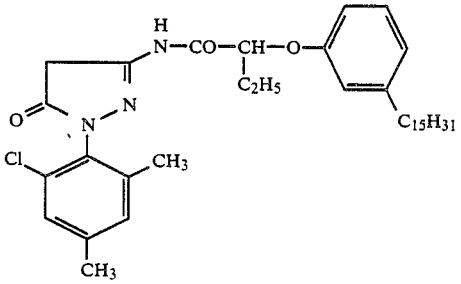
Pp 8
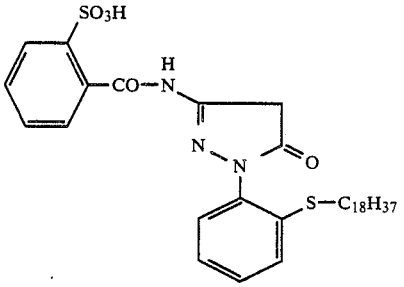

-continued
Pp 9
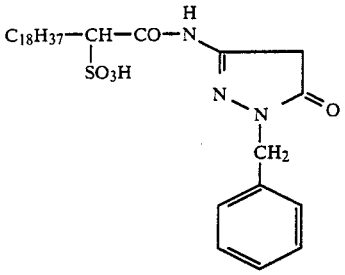
Pp 10
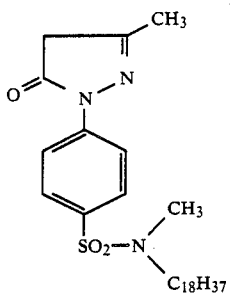
Pp 11
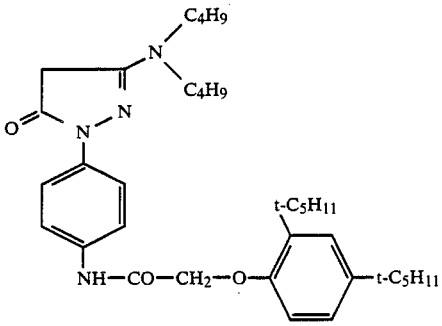
Pp 12
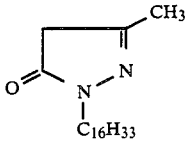
Pp 13
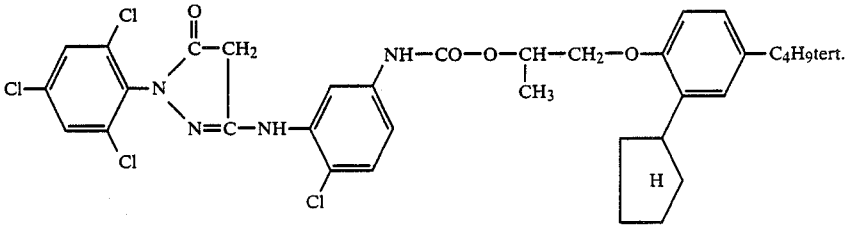
Pp 14
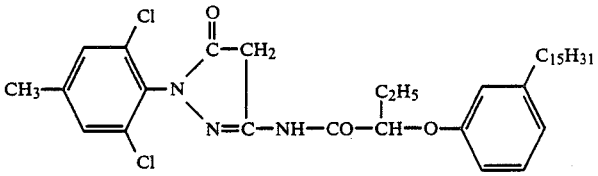
Pp 15
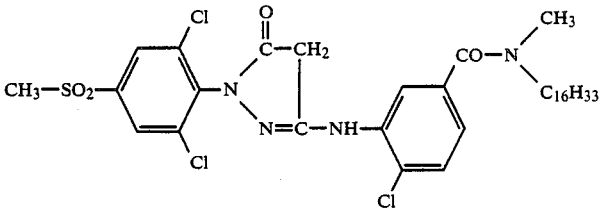
Pp 16
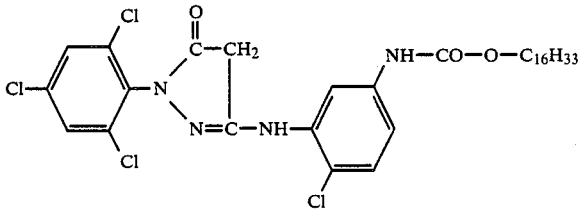

-continued
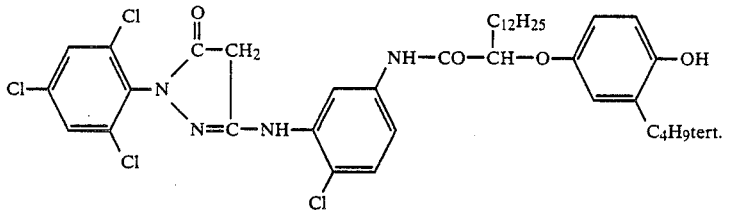
Pp 17
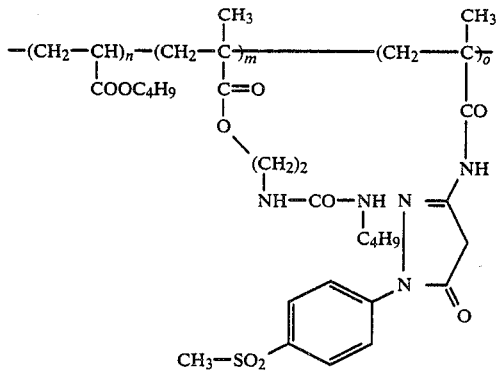
Pp 18
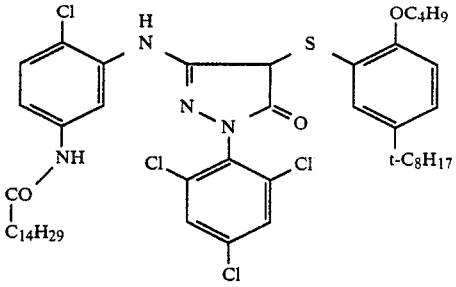
Pp 19
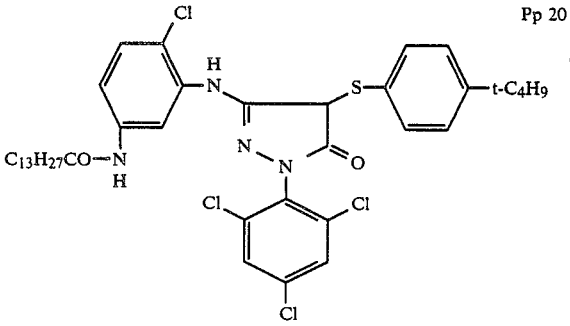
Pp 20
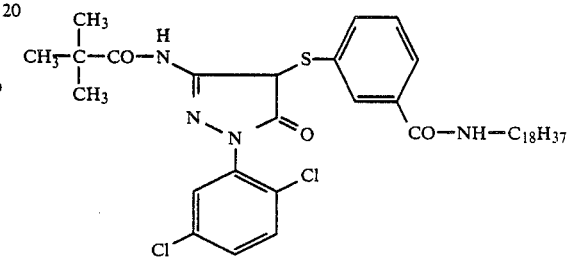
Pp 21
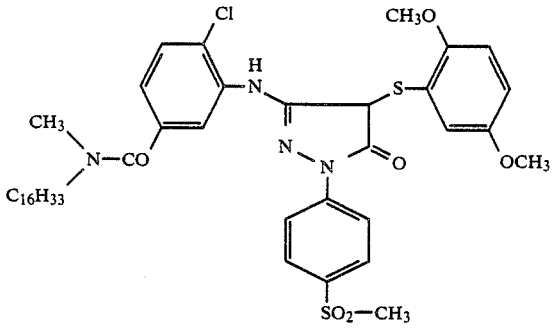
Pp 22
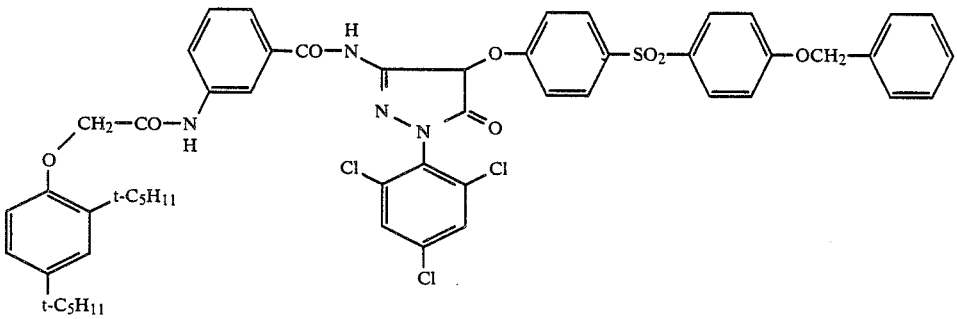
Pp 23

-continued

Pp 24

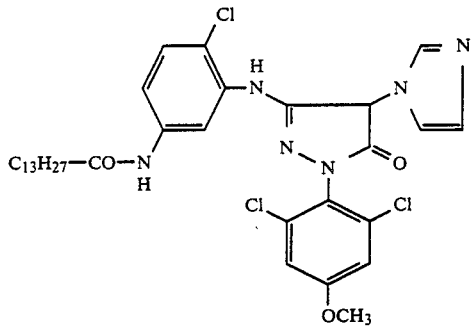

Pp 25

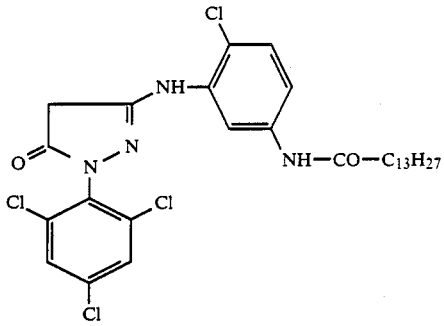

Pp 26

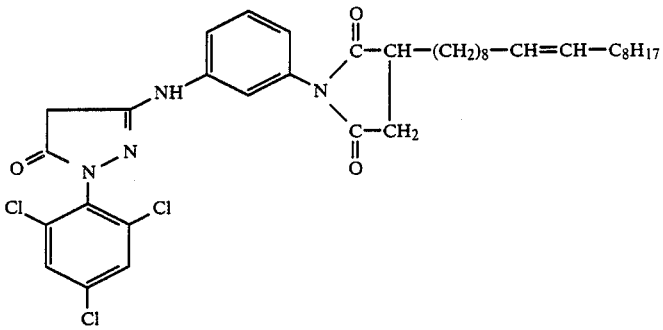

In one particularly preferred embodiment, at least one pyrazolo-azole magenta coupler is used in the green-sensitive layer. In this case, there is actually no need to use the yellow masking coupler in the green-sensitive layer. In one particularly preferred embodiment, the pyrazolo-azole couplers correspond to the following formula

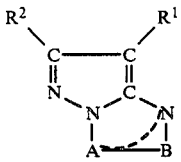

(I)

in which $R^1$ is a hydrogen atom or a group which can be split off during the coupling reaction, $R^2$ is hydrogen or a substituent of the type normally encountered in magenta couplers and A and B may be the same or different and represent an optionally substituted methine group or =N— or —NH—, in addition to which A and B may be part of an optionally fused ring, more especially an aromatic ring.

In one preferred embodiment, the pyrazolo-azole couplers correspond to one of the following formulae:

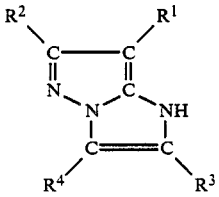

II

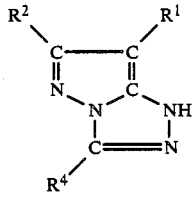

III in which $R^1$ is hydrogen or a releasable group, $R^2$ to $R^4$ may be the same or different and represent a hydrogen atom, a halogen atom, an alkyl group, an alkinyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxy carbonyl group, a ureido group, a sulfinyl group, an alkylthio group, an arylthio group or a cyano group, these groups being substituted or unsubstituted, in addition to which $R^3$ and $R^4$ may be condensed to form an aromatic ring.

The releasable group represented by $R^1$ is preferably a halogen atom (for example F. Cl. Br, I) or an organic group generally attached to the coupling site of the coupler molecule by an oxygen, sulfur or nitrogen atom. If the releasable group is a cyclic group, it may be attached to the coupling site of the coupler molecule either directly through an atom which is part of a ring, for example a nitrogen atom, or indirectly through an intermediate bond. Releasable groups of this type are known in large numbers, for example as leaving groups of 2-equivalent yellow couplers. Examples of suitable releasable groups can be found in particular in DE-OS No. 31 21 955 and in DE-OS No. 3 516 996.

Particularly useful, special pyrazolo-azoles PA are shown in the following Table:

PA 1 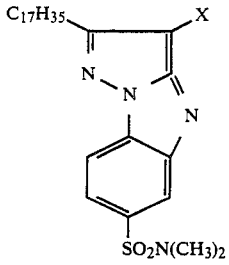
X = H
PA 2
X = —S—C6H13
PA 3
X = 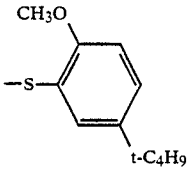
PA 19 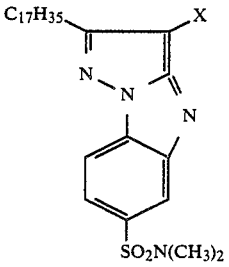
X = Cl
PA 20 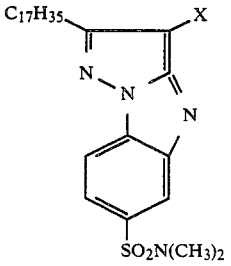
X = Br
PA 4 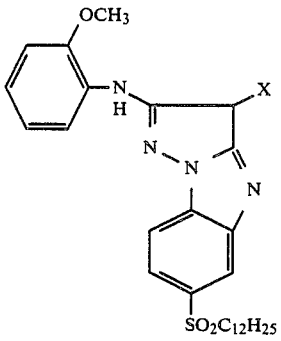
X = H
PA 5
X = 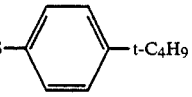
PA 6 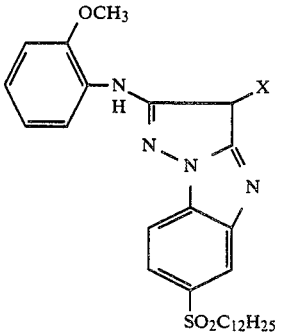
X = 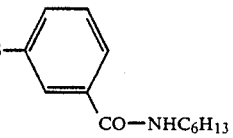

-continued
PA 7
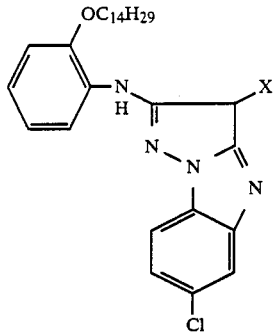
X = 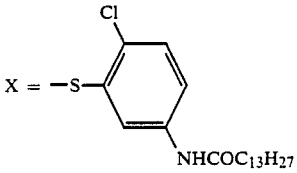
PA 8
X = 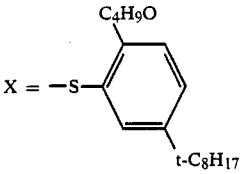
PA 9
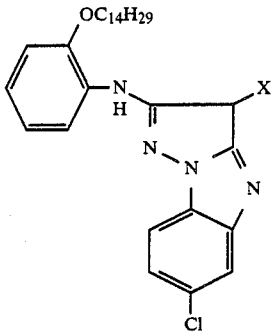
X = $-S-C_4H_9$
PA 10
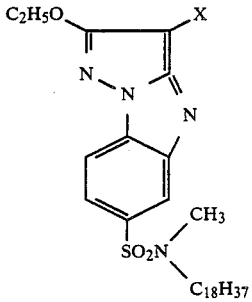
X = H
PA 11
X = 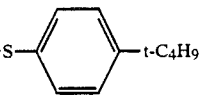
PA 12
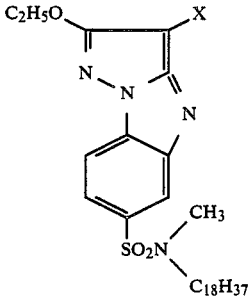
X = 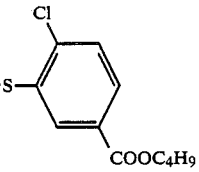
PA 18
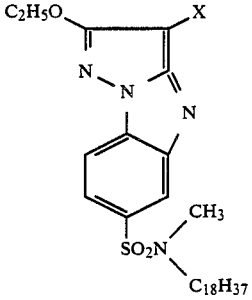
X = Cl -continued
PA 13
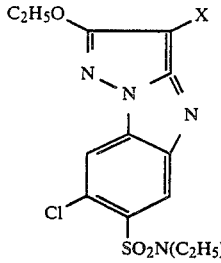
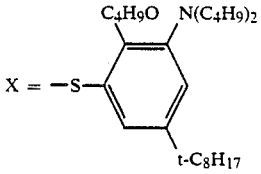
PA 14
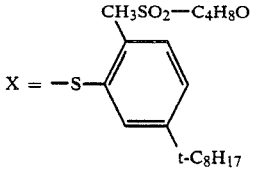
PA 15
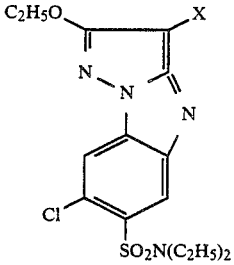
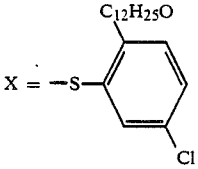
PA 16
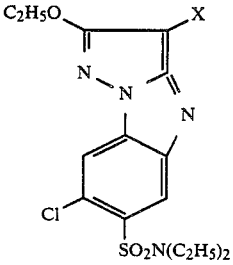
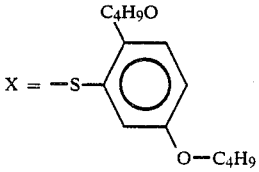
PA 17
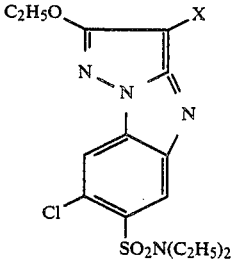
X = —S—$C_{12}H_{25}$
PA 21
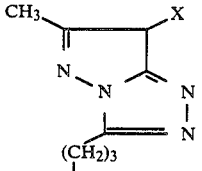
X = Cl
PA 22
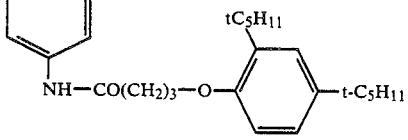
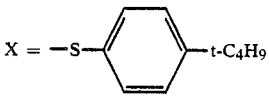

-continued
PA 23
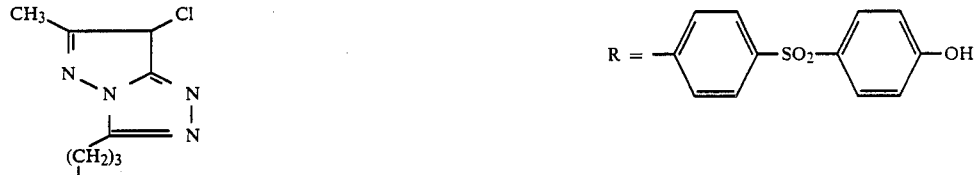
PA 24
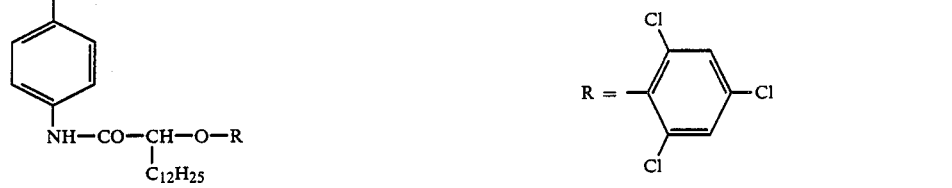
PA 25
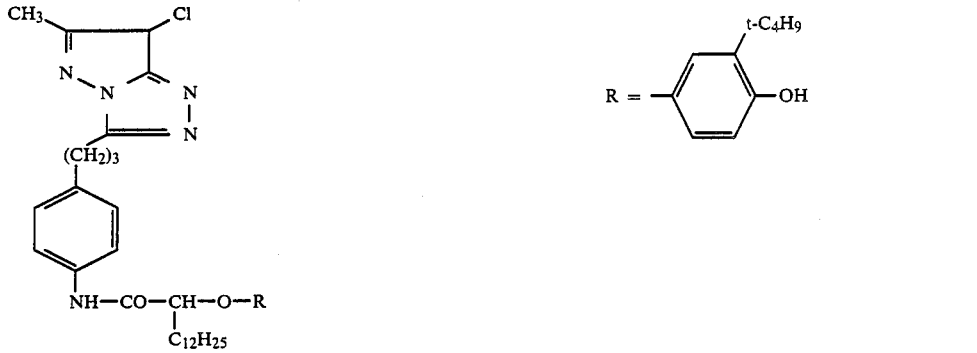
PA 26
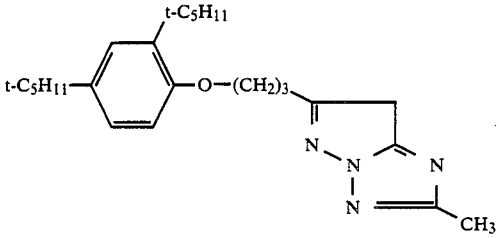
X = H
PA 27
X = Cl
PA 28
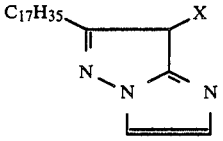
X = H
PA 29
X = Cl
PA 30
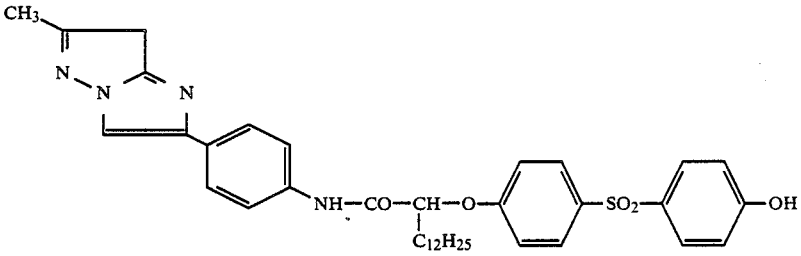
Suitable masking couplers are shown in the following Table:

M 1
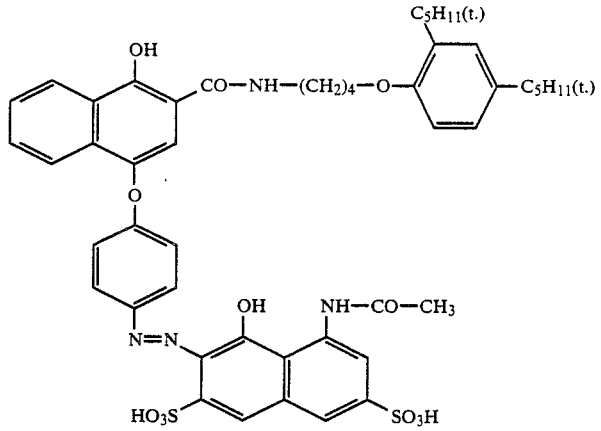
M 2
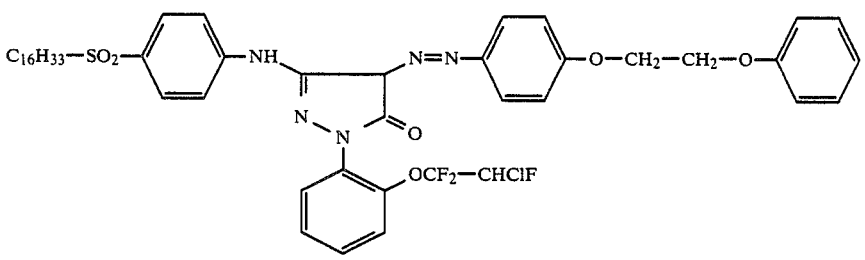
M 3
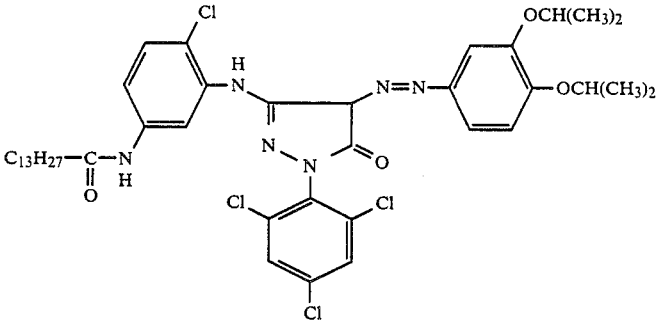
Suitable DIR couplers have the following structure for example:
DIR 1
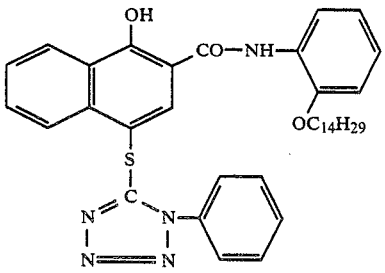
DIR 2
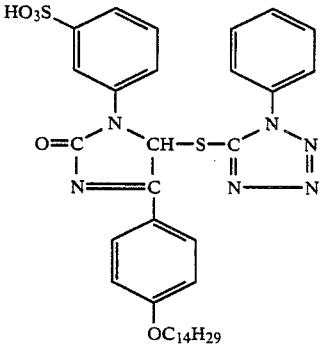

-continued

DIR 3

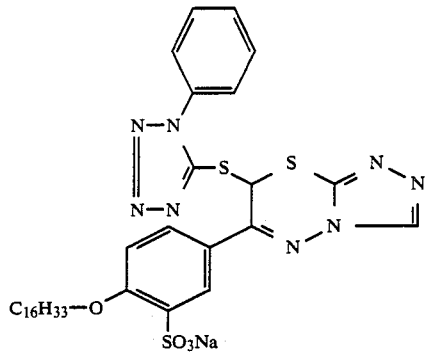

DIR 4

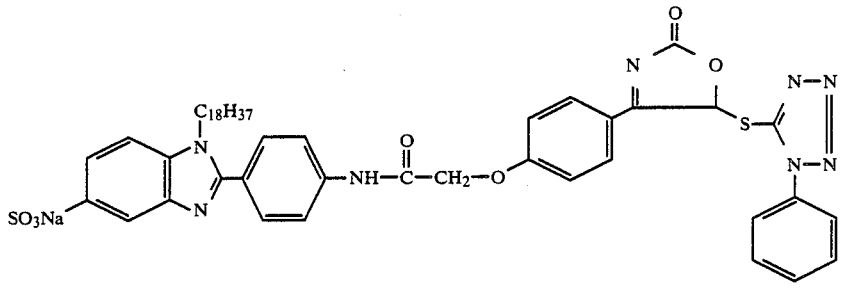

DIR 5

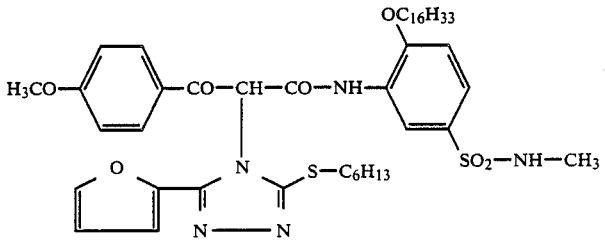

The constituents of the photographic material may be incorporated by standard known methods. Where the constituents are water-soluble or alkali-soluble compounds, they may be added in the form of aqueous solutions, optionally with addition of water-miscible organic solvents, such as ethanol, acetone or dimethylformamide. Where the constituents are compounds insoluble in water and alkalis, they may be incorporated in the recording materials in dispersed form by methods known per se. For example, a solution of these compounds in a low-boiling organic solvent may be directly mixed with the silver halide emulsion or first with an aqueous gelatin solution and the organic solvent subsequently removed. The resulting dispersion of the particular compound may then be mixed with the silver halide emulsion. So-called oil formers, generally relatively high boiling organic compounds which surround the compounds to be dispersed in the form of oily droplets, may also be used.

Reference is made in this connection, for example, to U.S. Pat. Nos. 2,322,027, 2,533,514, 3,689,271, 3,764,336 and 3,765,897. It is also possible to incorporate couplers for example in the form of charged latices, cf. DE-OS No. 2 541 274 and EP-OS No. 14 921. The constituents may also be incorporated in the material as polymers, cf. for example DE-OS No. 2 044 992, U.S. Pat. Nos. 3,370,952 and 4,080,211.

The usual layer supports may be used for the materials according to the invention, cf. Research Disclosure No. 17 643, Section XVII.

Suitable protective colloids and binders for the layers of the recording material are the usual hydrophilic film-forming agents, for example proteins, especially gelatin. Casting aids and plasticizers may also be used. Reference is made in this connection to the compounds mentioned in Sections IX, XI and XII of the above-cited Research Disclosure No. 17 643.

The layers of the photographic material may be hardened in the usual way, for example with hardeners of the epoxide, heterocyclic ethylene imine and acryloyl type. In addition, the layers may be hardened in accordance with DE-OS No. 2 218 009 to produce color photographic materials which are suitable for high-temperature processing. It is also possible to harden the photographic layers with hardeners of the diazine, triazine or 1,2-dihydroquinoline series or with hardeners of the vinylsulfone type. Other suitable hardeners are known from DE-OS No. 2 439 551, 2 225 230 and 2 317 672 and from the above-cited Research Disclosure 17 643, Section XI.

Other suitable additives are described in Research Disclosure 17 643 and in Product Licensing Index of December 1971, pages 107–110.

Suitable color developers for the material according to the invention are, in particular, those of the p-phenylenediamine type, for example 4-amino-N,N-diethylaniline hydrochloride; 4-amino-3-methyl-N-ethyl-N-β-(methanesulfonamido)-ethylaniline sulfate hydrate; 4-amino-3-methyl-N-ethyl-N-β-hydroxyethylaniline sulfate; 4-amino-N-ethyl-N-(2-methoxyethyl)-m-toluidine di-p-toluene sulfonic acid and N-ethyl-N-β-hydroxyethyl-p-phenylenediamine. Other suitable color developers are described, for example, in J. Amer, Chem. Soc. 73, 3100 (1951) and in G. Haist, Modern Photographic Processing, 1979, John wiley and Sons, New York, pages 545 et seq.

After color development, the material is bleached and fixed in the usual way. Bleaching and fixing may be carried out separately from or even together with one another. Suitable bleaches are the usual compounds, for example $Fe^{3+}$-salts and $Fe^{3+}$-complex salts, such as ferricyanides, dichromates, water-soluble cobalt complexes, etc. Particularly preferred bleaches are iron(III) complexes of aminopolycarboxylic acids, more especially for example ethylenediamine tetraacetic acid, nitrilotriacetic acid, iminodiacetic acid, N-hydroxyethyl ethylenediamine triacetic acid, alkyliminodicarboxylic acids and of corresponding phosphonic acids. Persulfates are also suitable bleaches.

The following Examples, which describe preferred embodiments of the invention, are intended to illustrate the invention. Unless otherwise indicated, percentages represent percentages by weight while quantities are based on the corresponding application per square meter of recording material. The silver halide application is indicated through the equimolar quantity of silver nitrate.

Silver chloride emulsions used in accordance with the invention:

A silver chlorobromide emulsion of the core-shell type is prepared by pAg-controlled dual inflow. To this end, AgCl/AgBr is precipitated onto a monodisperse AgCl core emulsion in such a quantity that a ratio by volume of core to shell of 2.6 to 97.4 was obtained. The emulsion had a cubic crystal habit with an average particle size of 0.81 μm and a total chloride content of 95 mole %. The emulsion was ripened with gold-sulfur to maximum sensitivity with particular emphasis on a favorable sensitivity-to-fog ratio.

EXAMPLE 1 (Comparison)

The following layers were applied in the order indicated to a cellulose triacetate support:

Layer 1

Antihalo layer of black colloidal silver

Layer 2

Gelatin-containing intermediate layer, thickness 1 μm, containing a white coupler corresponding to the following formula

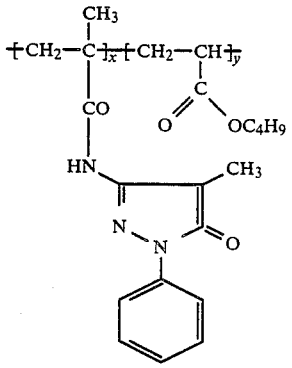

x = 73 ± 2% by weight
y = 27 ± 2% by weight

Layer 3

A blue-sensitive silver halide emulsion layer consisting of a silver bromide iodide emulsion (5.5 mole % iodide, mean grain diameter 0.5 μm) containing a yellow coupler corresponding to formula Y 1 and a DIR coupler corresponding to formula DIR 5.

Silver application: 10.4 mmoles $AgNO_3$ per $m^2$
Yellow coupler: 1.4 mmoles per $m^2$
DIR coupler: 0.2 mmole per $m^2$ Layer 4

Gelatin-containing intermediate layer containing the same white coupler as layer 2.

Layer 5

Red-sensitive silver halide emulsion layer containing a silver bromide iodide emulsion of the core/shell type (7 mole % silver iodide, mean grain diameter 0.4 μm) and a cyan coupler corresponding to formula C 1, a masking coupler corresponding to formula M 1 and a DIR coupler corresponding to formula DIR 1.

Silver application: 18.9 mmoles silver nitrate per $m^2$
Magenta coupler: 1.3 mmoles per $m^2$
Masking coupler: 0.05 mmole per $m^2$
DIR coupler: 0.04 mmole per $m^2$ Layer 6

Gelatin-containing intermediate layer containing the same white coupler as layer 2.

Layer 7

Green-sensitive silver halide emulsion layer containing a silver bromide iodide emulsion of the core/shell type (7 mole % silver iodide, mean grain diameter 0.4 μm), a magenta coupler corresponding to formula Pp 2, a yellow masking coupler corresponding to M 3, a DIR coupler corresponding to formula DIR 3 and another DIR coupler corresponding to formula DIR 4.

Silver application: 14.8 mmoles silver nitrate per $m^2$
Magenta coupler: 0.9 mmole per $m^2$
Masking coupler: 0.09 mmole per $m^2$
DIR 3: 0.03 mmole per $m^2$
DIR 4: 0.001 mmole per $m^2$ Layer 8

Protective layer of gelatin, thickness 1 μm, containing a UV-absorber corresponding to the following formula

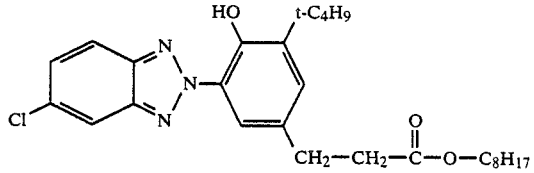

Layer 9

Gelatin surface layer containing an instant hardener introduced into the photographic recording material by "diffusion hardening". The surface layer has the following composition:

| | |
|---|---|
| Gelatin solution, 5% by weight in water | 100 g |
| Water, deionized | 770 g |
| Hardener corresponding to the formula | 100 g |

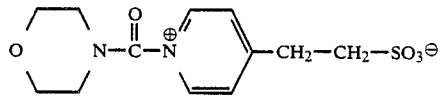

10% by weight in water
Wetting agent corresponding to the formula $[C_8F_{17}SO_3]^{\ominus}[N(C_2H_5)_4]^{\oplus}$ 30 g
4% by weight in water -continued

| | |
|---|---|
| Wet application of layer 9 | 60 g/m² |

EXAMPLE 2

(Invention)

The following layers are applied in the order indicated to a layer support:

Layer 1

Antihalo layer of black colloidal silver

Layer 2 Gelatin-containing intermediate layer, thickness 1 μm, containing a white coupler corresponding to the following formula

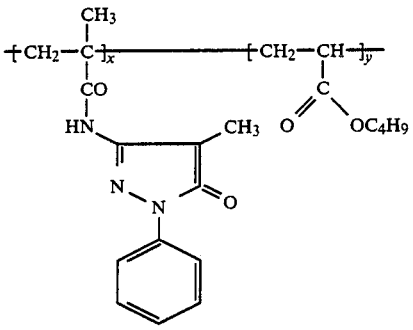

x = 73 ± 2% by weight
y = 27 ± 2% by weight

Layer 3

A blue-sensitive silver halide emulsion layer consisting of a silver bromide iodide emulsion (5.5 mole % iodide, mean grain diameter 0.5 μm) containing a yellow coupler corresponding to formula Y 1 and a DIR coupler corresponding to formula DIR 5.

Silver application: 10.4 mmoles $AgNO_3$ per m²

Yellow coupler: 1.4 mmoles per m²

DIR coupler: 0.2 mmole per m²

Layer 4

Gelatin-containing intermediate layer containing the same white coupler as layer 2.

Layer 5

Red-sensitive silver chloride emulsion with the composition indicated above used in accordance with the invention, containing cyan coupler C 1, masking coupler M 1 and DIR coupler DIR 1.

Silver application: 11.9 mmoles silver nitrate per m²

Cyan coupler: 1.35 mmoles per m²

Masking coupler: 0.06 mmole per m²

DIR coupler: 0.02 mmole per m²

Layer 6

Gelatin-containing intermediate layer containing the same white coupler as layer 2.

Layer 7

Green-sensitive silve chloride emulsion layer with the composition indicated above containing magenta coupler Pp 2, masking coupler M 3 and DIR couplers DIR 3 and DIR 4. Silver application: 11.2 mmoles silver nitrate per m² Magenta coupler: 1.0 mmole per m² Masking coupler: 0.1 mmole per m² DIR 3: 0.02 mmole per m² DIR 4: 0.001 mmole per m²

Layer 8

Protective layer of gelatin, thickness 1 μm, containing a UV-absorber.

Layer 9

Gelatin surface layer containing an instant hardener introduced into the photographic recording material by "diffusion hardening". The surface layer has the following composition:

| | |
|---|---|
| Gelatin solution, 5% by weight in water | 100 g |
| Water, deionized | 770 g |
| Hardener corresponding to the formula | 100 g |

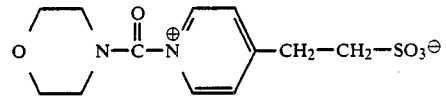

| | |
|---|---|
| 10% by weight in water | |
| Wetting agent as Example 1, layer 9 | 30 g |
| 4% by weight in water | |
| Wet application of layer 9 | 60 g/m² |

EXAMPLE 3

(Invention)

A layer unit was prepared in the same way as in Example 2 except that the pyrazolo-azole PA 11 is used in the green-sensitive layer instead of the magenta coupler indicated in Example 2 and that no masking coupler is used in this layer.

Silver application: 11.2 mmoles $AgNO_3$/m²

Magenta coupler: 1.7 mmoles/m²

DIR 3: 0.02 mmole/m²

DIR 4: 0.001 mmole/m²

As can be seen from the following Table, color separation is poor in Comparison Example 1 and is considerably improved in accordance with the invention. The distinctly improved blue sensitivity in Example 3 according to the invention using a pyrazolo-azole is particularly noteworthy.

The color separations ΔF blue-green and ΔF blue-red, which are relevant to the color reproduction of the photographic recording material according to the invention, are measured as follows:

In accordance with DIN 4512, a grey wedge is exposed onto a color photographic recording material adapted for daylight exposure behind a blue separation filter (=U 449 of the Agfa-Gevaert range, described in Agfa-Gevaert-Filter Brochure No. 406) and, after negative development (by the Kodak Flexicolor process), the sensitivity of the blue separation is measured. Good color reproduction, particularly for blue shades, is obtained when the sensitivity difference ΔF between the blue-sensitive and green-sensitive (and between blue-sensitive and red-sensitive) layers in the blue separation is at least 1.0 lg H.

In order to obtain these data, the materials were exposed imagewise and subjected to the color negative development process described in British Journal of Photography Annual 1979, page 204.

| Measured quantities | Example 1 Comparison | Example 2 (Invention) | Example 3 (Invention) |
|---|---|---|---|
| Sensitivity in — red | 23 DIN | 19 DIN | 19 DIN |
| Sensitivity in — green | 23 DIN | 22 DIN | 22 DIN |
| Sensitivity in — blue | 21 DIN | 21 DIN | 23 DIN |
| Color separation ΔF — blue-green | ±0 lgH | 1.0 lgH | 1.0 lgH |
| Color separation ΔF — blue-red | 0.4 lgH | 2.2 lgH | 2.4 lgH |

We claim:

1. A color photographic recording material comprising at least two blue-sensitive, at least two green-sensitive and at least two red-sensitive silver halide emulsion layers and associated coupler, wherein the improvement comprises the absence of a blue light absorbing filter layer and a green-sensitive silver halide emulsion layer arranged in such a way that, on exposure, it is closest of all the photosensitive silver halide emulsion layers to the subject to be photographed and contains a silver halide of which at least 50 mole-% consists of silver chloride, have a layered grain structure and show a crystal form in which the ratio of diameter to thickness is at most 5.

2. A color photographic recording material as claimed in claim 1, characterized in that the green-sensitive layer contains a color coupler corresponding to the following general formula

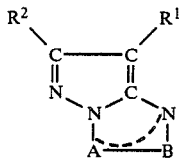

(I)

in which $R^1$ is a hydrogen atom or a group releasable during the coupling reaction, $R^2$ is hydrogen or a substituent of the type normally encountered in magenta couplers and A and B are the same or different and represent an optionally substituted methine group or =N— or —NH—, in addition to which A and B may be part of an optionally fused ring, particularly an aromatic ring.

3. A color photographic recording material as claimed in claims 1 or 2, characterized in that at least 70% of the silver halide emulsion in the green-sensitive layer consists of silver chloride.

4. A color photographic recording material as claimed in claims 1 or 2, characterized in that the green-sensitive layer contains a silver halide emulsion of which the grains have a layered grain structure of at least two regions differing in their halide composition, the grains being characterized in that at least 60 mole % of the halide is chloride and at least one region B contains at least 10 mole %, but less than 50 mole % silver bromide.

5. A color photographic recording material as claimed in claims 1 or 2, characterized in that the silver halide emulsion in the green-sensitive layer consists essentially of grains which comprise a zone $Z_{Br}$, at least 60 mole % of the halide being chloride, the bromide content in the zone $Z_{Br}$ being at least 50 mole % and no bromide-rich zone $Z_{Br}$ being present at the surface of the silver halide grains.

* * * * *